United States Patent [19]

Pouri et al.

[11] 4,442,753

[45] Apr. 17, 1984

[54] CAROUSEL AUTOMATIC AMMUNITION LOADER SYSTEM

[75] Inventors: Theodore H. Pouri; Howard C. Mottin, both of Macomb, Mich.

[73] Assignee: The United States of America as represented by the Secretary of the Army, Washington, D.C.

[21] Appl. No.: 421,602

[22] Filed: Sep. 22, 1982

[51] Int. Cl.[3] ..... F41F 9/04

[52] U.S. Cl. ..... 89/46; 89/33 MC; 89/34; 89/36 K

[58] Field of Search ..... 89/33 A, 33 B, 36 A, 89/36 K, 45, 46, 47

[56] References Cited

U.S. PATENT DOCUMENTS 4,318,331 3/1982 Echtler et al. ..... 89/46

4,388,854 6/1983 Dabrowski et al. ..... 89/46

*Primary Examiner*—Stephen C. Bentley

*Attorney, Agent, or Firm*—Peter A. Taucher; John E. McRae; Robert P. Gibson

[57] ABSTRACT

An ammunition handling system for use in a military tank to provide for storage of individual ammunition rounds and automatic transfer thereof to the tank main gun when necessary. The rounds are stored in protected positions within the hull remote from the gun. Transfer of individual rounds to the gun is effected through a rotary carousel located beneath the tank basket. The carousel moves independently of the basket to deliver rounds into the basket in any basket position; the gun can be reloaded without returning to a fixed load position.

2 Claims, 7 Drawing Figures

CAROUSEL AUTOMATIC AMMUNITION LOADER SYSTEM

GOVERNMENT INTEREST

The invention described herein may be manufactured, used, and licensed by or for the Government for governmental purposes without payment to us of any royalty thereon.

BACKGROUND AND SUMMARY OF THE INVENTION

This invention relates to an ammunition handling system usable in military vehicles for storing individual rounds in the vehicle hull, and transferring same to the firing chamber of the vehicle main gun without human assistance, other than control operations.

The invention has some general similarities to the system shown in copending patent application, Ser. No. 238,313 filed on Feb. 26, 1981 in the names of Dabrowski et al, now U.S. Pat. No. 4,388,854. The present invention seeks to provide an ammunition storing-loading system having the following general advantages:

1. number of stored rounds is not limited by the size of the gun turret,
2. turret movement is unencumbered by a large mass of ammunition,
3. ammunition is stored in, protected positions within the hull, not in the bustle of the turret where the rounds would have greatest exposure to enemy fire,
4. rounds are loadable into the gun in any rotated position of the turret, i.e. the turret does not have to return to a fixed start position to retrieve a selected round,
5. during any given gun-loading cycle only the selected round has to be moved, thus minimizing peak power requirements, and
6. ammunition-transfer operations are performed by multiple power systems that operate independently of one another, whereby many of the movements can be performed simultaneously or at selected times, thus potentially reducing the gun-load cycle time.

THE DRAWINGS

FIG. 1 is a fragmentary sectional view taken through a military vehicle containing one form of our invention.

FIGS. 2 and 3 are fragmentary sectional views taken on lines 2—2 and 3—3 in FIG. 1.

Figure 1:
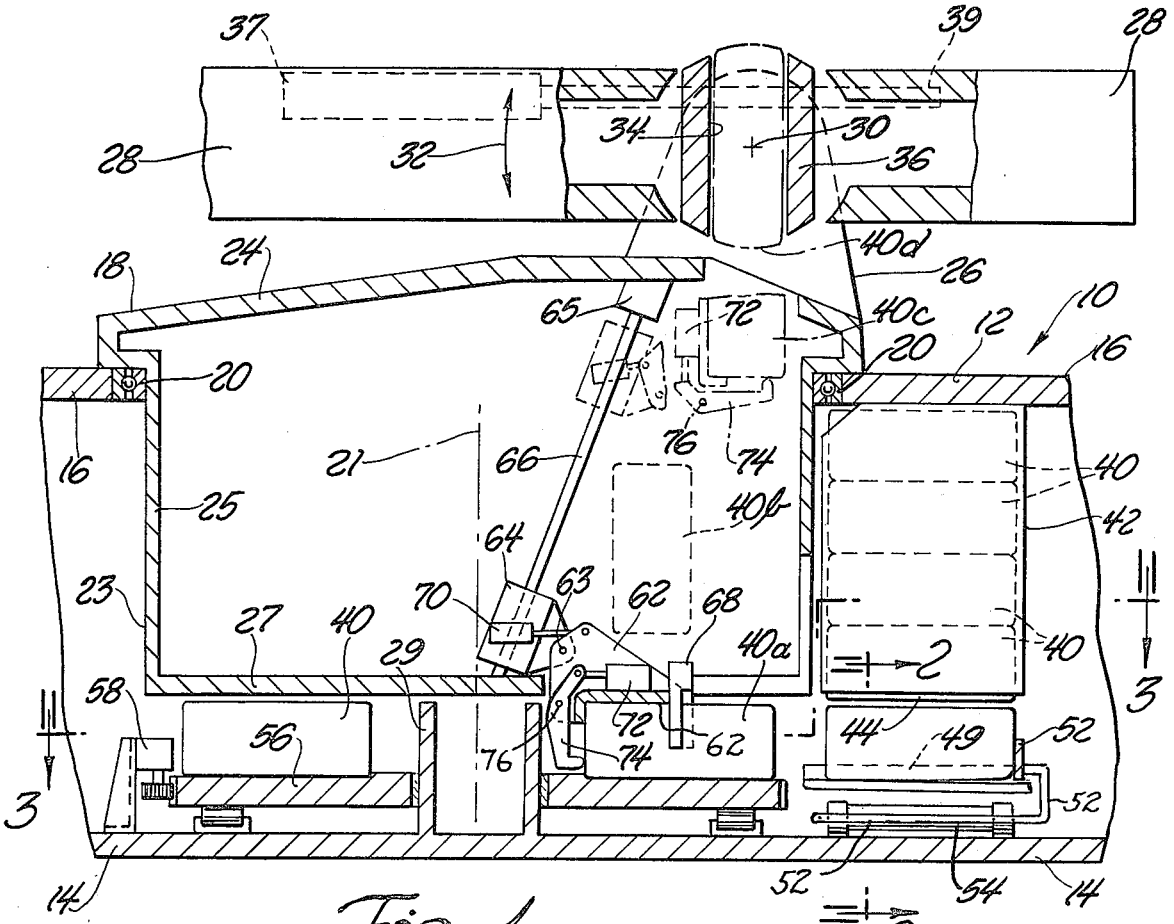
Figure 2:
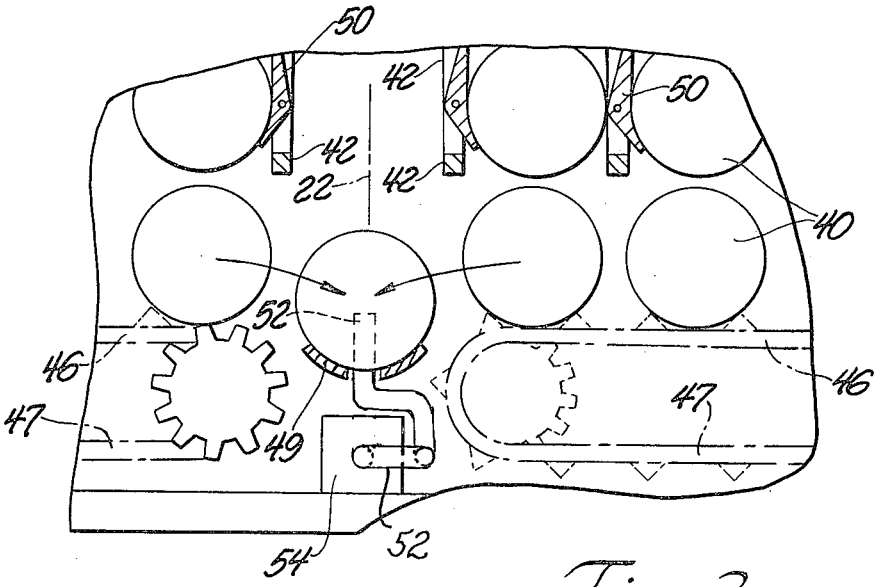
Figure 3:
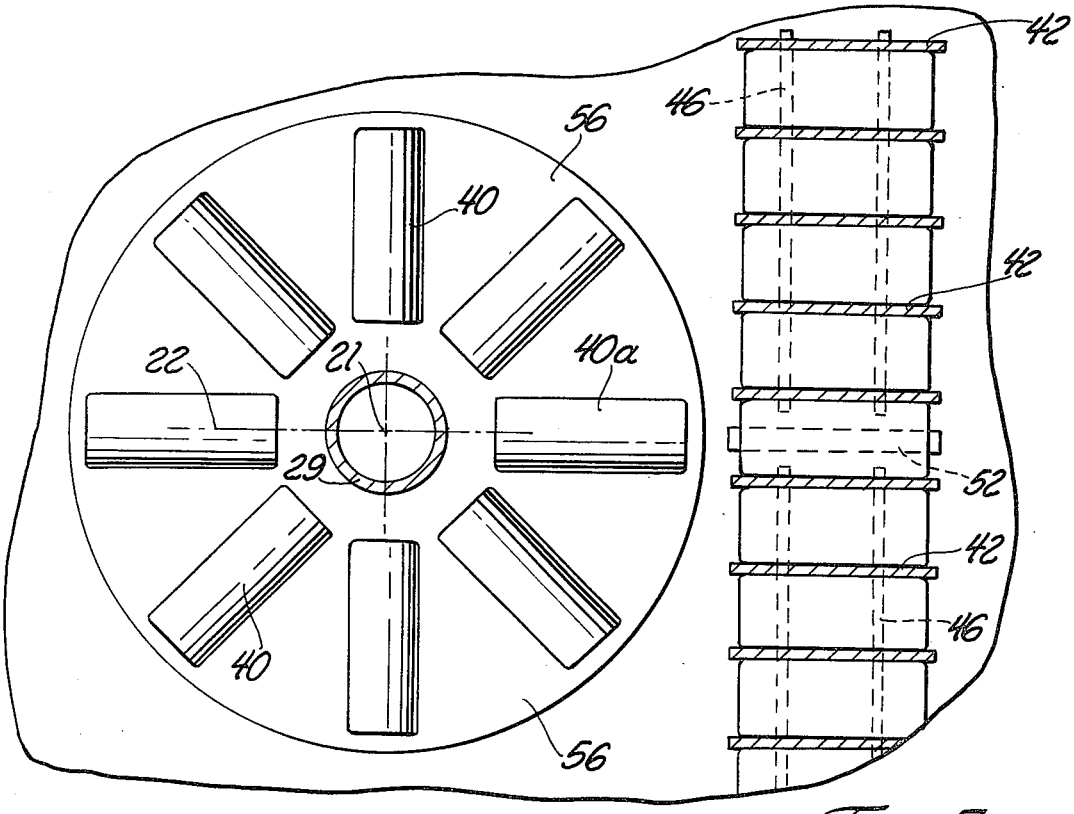

Referring in greater detail to FIGS. 1 through 3, there is fragmentarily shown a tracked military vehicle 10 that includes a hull 12 having a bottom wall 14 and top wall 16. Centrally positioned on the hull is a powered turret 18 supported on the usual anti-friction bearing 20; a motor (not shown) powers the turret for rotary motion in the azimuth plane around axis 21 located on the longitudinal centerline 22 (FIG. 3) of the vehicle. The turret carries a circular basket 23 that includes depending walls or bars 25 and a circular floor 27. Electrical power for the turret mechanisms is delivered through a slip ring assembly located within a circular housing 29 carried by the hull bottom wall 14.

Roof 24 of the turret carries upstanding trunnion plates 26 that rotatably support the vehicle main gun 28 for adjusting elevational movements around axis 30, as denoted by arrow 32. The gun firing chamber 34 is defined by a rotary tubular member 36 supported within the gun breech block on bearings coincident with axis 30. A fluid cylinder 37 and linkage 39 may be arranged on the gun to rotate member 36 between the FIG. 1 ammunition-load position and the firing position aligned with the gun barrel. Member 36 moves independently of the gun so that member 36 can be rotated to the illustrated load position in any elevated position of the gun. The gun, and its mounting, is not part of our invention.

Our invention relates in part to means for storing rounds of ammunition 40 within hull 12 in close proximity to basket 23. The storing means comprises a series of spaced vertical walls 42 extending parallel to the hull centerline 22 to define eight vertical chutes for the ammunition. The number of chutes is determined by the hull width and diameter of the ammunition; preferably the chutes occupy the entire interior hull width, i.e. the space encompassed by the hull side walls. Each chute wall 42 has a lower edge 44 located above the hull bottom wall to define a subjacent space for two conveyors 46 (FIG. 2). In the illustrated system each chute contains or stores four rounds of ammunition; eight chutes store a total of thirty two rounds. The two conveyors carry eight additional rounds.

As fragmentarily shown in FIG. 2, each conveyor includes a set of chains 47 trained around sprockets which intermittently drive the conveyor chains toward the hull centerplane 22, causing the supported rounds to be deposited in a stationary trough 49. The sprockets for the individual conveyors may be operated at different times to deliver rounds from the left chutes or the right chutes into trough 49. If desired, different types of ammunition, of the same caliber, may be stored in the left and right chutes. To prevent ammunition in the chutes from interferring with conveyor motion, each chute may be equipped with a swingable gate 50 at its lower end; normally the gates support the rounds above the subjacent conveyor. When the conveyor is empty the superjacent gates 50 are powered to release the lowermost rounds onto the conveyor. The next superjacent round of ammunition in each chute cams the gate back to the latched position shown in FIG. 2.

Trough 49 is slotted to accommodate a round-puller element 52 carried by the piston rod of a fluid cylinder 54. Leftward movement of the piston rod causes element 52 to transfer an individual round of ammunition from trough 49 to a predetermined position 40*a* on a rotary carousel or table 56 that is located in the space between hull bottom wall 14 and floor 27 of the turret basket. Carousel or table 56 is rotatable in a horizontal plane around turret rotation axis 21; however the carousel is separate from the basket, whereby the carousel and turret are independently movable. The carousel can be powered or indexed to different positions or stations by means of a motor 58 having a pinion gear meshed with a large ring gear carried by the carousel. The carousel (table) can support eight rounds of ammunition in radial positions, as shown in FIG. 3. Round transfer onto the carousel is accomplished by alternate and sequential actuation of cylinder 54 and motor 58.

Figure 7:
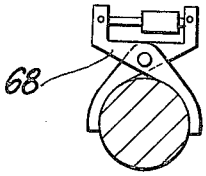
FIG. 7 shows a structural detail that may be used in the FIG. 1 or FIG. 4 ammunition transfer system.

A mechanism is provided within basket 23 for transferring an individual round of ammunition upwardly from position 40*a* on carousel 56 to position 40*d* in firing chamber 34. The specific details of the transfer mechanism are not part of our invention. However, for illustration purposes we show the transfer mechanism as comprising a carriage 62 having pivotal connection 63 to a ball nut 64. A motor 65 rotates an elongated screw 66, which causes the ball nut to move upwardly from the full line position to the dotted line position. Carriage 62 carries a power-operated tongs 68 of the type shown in FIG. 7.

With tongs 68 engaged on the selected round of ammunition, a fluid cylinder 70 is actuated to swing carriage 62 counterclockwise, thereby placing the round in position 40*b*. Motor 65 operates to elevate the round to position 40*c*, after which a small fluid cylinder 72 may be actuated to swing a pusher element 74 counterclockwise around pivot connection 76, thus driving the round upwardly into the gun firing chamber. The round ejects a spent cartridge from the chamber.

Although different types of mechanisms may be used to transfer a round of ammunition upwardly from position 40*a* to position 40*d*, the mechanism is preferably designed to take into account the fact that two humans occupy the turret basket; one acts as the tank commander and the other functions as the gunner. The round transfer mechanism must occupy only the central diammetrical portion of the basket interior space, leaving the segmental spaces alongside the transfer means free to accommodate seated humans. The mechanism shown in FIG. 1 is confined to essentially a single central plane within the basket, leaving considerable space alongside for human occupancy.

Figure 4:
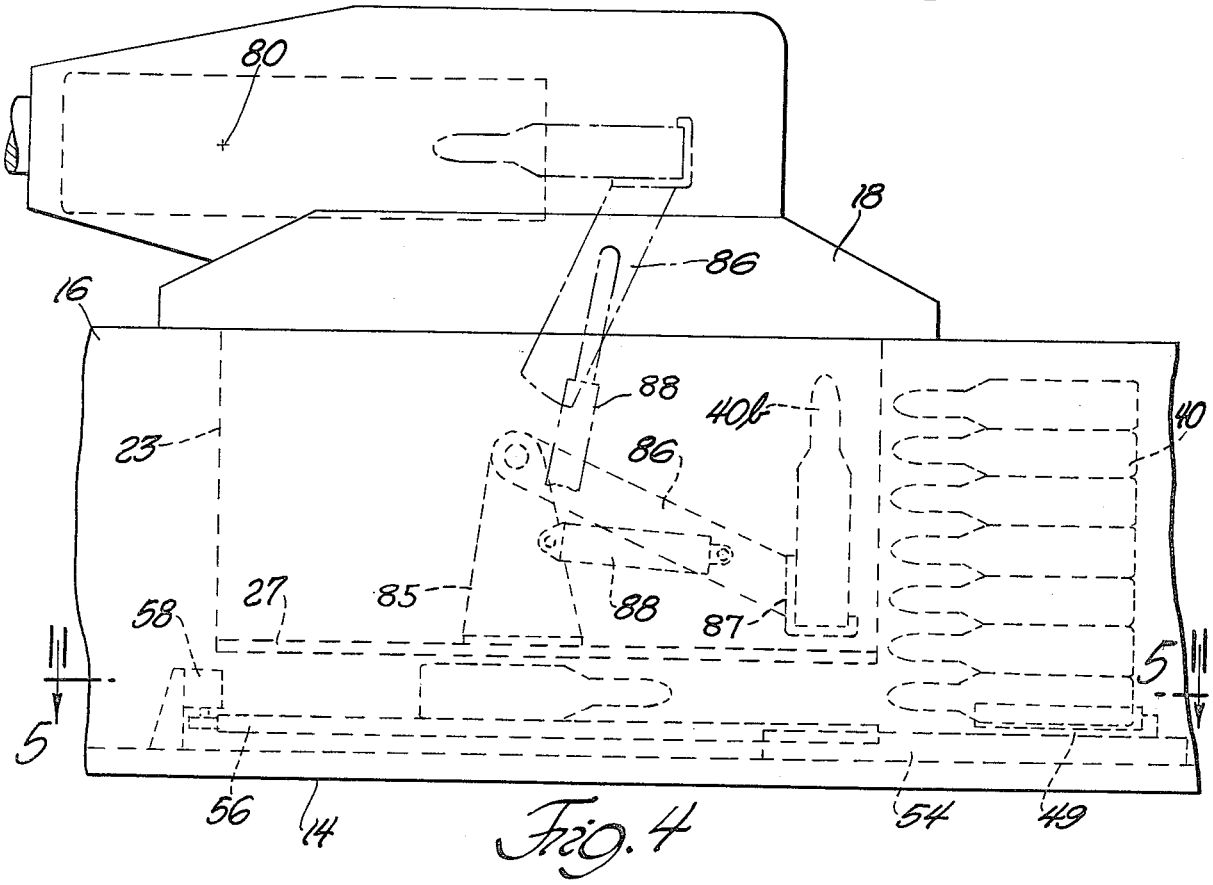
FIG. 4 is a fragmentary side elevational view of another military vehicle containing our invention.
Figure 5:
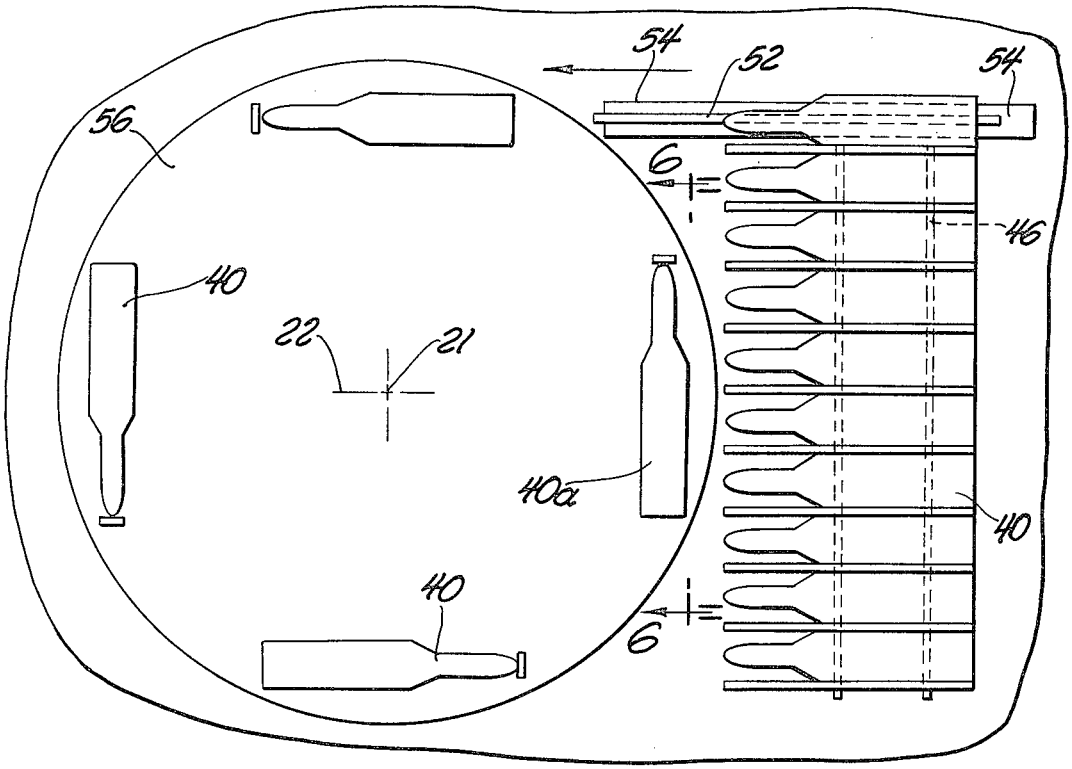
FIG. 5 is a sectional view taken on line 5—5 in FIG. 4.
Figure 6:
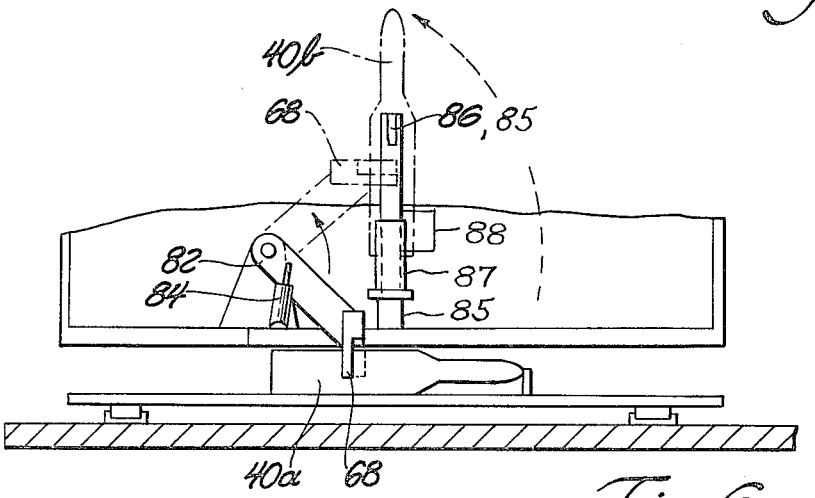
FIG. 6 is a sectional view on line 6—6 in FIG. 5.

FIGS. 4 through 6 depict a system that is similar to that shown in FIGS. 1 through 3. However in this case the gun is a larger caliber weapon having a different mounting on the turret and a different type of breech block for holding the round in the firing chamber. The gun is mounted on the turret for elevational movement around a horizontal axis 80. The breech block is movably mounted on the rear end of the gun to permit the ammunition round to enter the firing chamber by a forward axial motion.

The ammunition storing means is similar to that previously described except that round transfer element 52 is located outboard from the longitudinal axis 22 of the hull to have a line of action generally tangential to carousel motion. The transverse conveyor means 46 consists of one long conveyor rather than two separate conveyors.

Carousel 56 supports four rounds of ammunition in the tangential positions shown in FIG. 5. FIG. 6 shows suitable means for transferring an individual round of ammunition from prone position 40*a* on the carousel to a vertical position 40*b* shown in FIGS. 6 and 4. The transfer means includes a swingable arm 82 that carries a power tongs 68; fluid cylinder 84 swings the arm upwardly to position the round in a vertical attitude. As shown in FIG. 4, a second arm 86 is operated by a fluid cylinder 88 to move the round upwardly and arcuately into the gun firing chamber. The transfer mechanism is confined to a central plane of the basket, leaving free areas alongside the mechanism for accommodating humans.

The systems shown in FIGS. 1 through 7 are believed advantageous in that the number of stored rounds in the hull have no effect on the size of the turret. The FIG. 1 system provides for the storage of forty rounds in the hull. The FIG. 4 system provides for the storage of fifty-four rounds in the hull (six rounds in each of nine vertical chutes). In each case the rounds are stored in the hull, not in the turret. The turret can be relatively small in the vertical and horizontal directions, thus presenting a lower target profile to the enemy gunners. The smaller size turret weighs less so that slewing motions can be accomplished more expeditiously, especially since there is no requirement for moving the mass of the stored rounds.

Storage of the rounds in the hull is also advantageous in that the rounds are more completely protected from enemy fire, compared to locations in the turret or turret bustle.

It is also believed that the illustrated systems are capable of relatively quick load cycle times. This is due partly to the fact that carousel 56 can be rotated to any selected position beneath basket 23, whereby any or all of the rounds on the carousel can be transferred into the gun firing chamber without replenishment of rounds from the hull storage area. In this connection, note that while the gun is firing a given round the carousel can be moved to locate the next round in the gun-load position 40*a*. The carousel and turret can be moving simultaneously to permit target-acquisition action and ammunition loading at the same time.

Uninterrupted firing can be achieved up to the capacity of carousel 56, eight rounds with the FIG. 3 arrangement and four rounds with the FIG. 5 system. If it becomes necessary to fire continuously beyond the carousel capacity, then the transfer mechanism 52 can be operated to replenish the carousel when it is motionless.

The systems are also believed advantageous as regards minimization of peak power requirements, due to the fact that conveyor means 42, transfer cylinder 54, carousel motor 58, elevational motor 65, etc. can be programmed to operate at different times in the cycle.

We wish it to be understood that we do not desire to be limited to the exact details of construction shown and described for obvious modifications will occur to a person skilled in the art.

We claim:

1. In a military vehicle comprising a hull having a longitudinal centerline and a bottom wall, a turret mounted on the hull for rotational movement in the azimuth plane, a gun mounted atop the turret for movement in the elevational plane, and a basket depending from the turret within the hull, said basket including a floor spaced a short distance above the hull bottom wall: the improvement comprising means for storing a multiple number of ammunition rounds within the hull is proximity to the basket; said ammunition storing means comprising a number of spaced vertical walls (42) extending parallel to the hull longitudinal centerline to define a series of vertical chutes, the width of each chute measured transverse to the hull longitudinal centerline corresponding to the diameter of an ammunition round whereby the various chutes are enabled to store ammunition rounds one above another in prone positions parallel to the hull longitudinal centerline; conveyor means (46) running beneath the vertical chutes along the hull bottom wall and transverse to the hull longitudinal centerline; a stationary round support means (49) located in the movement plane of the conveyor means for receiving an individual round of ammunition discharged from said conveyor means; a table

(56) located beneath the basket floor in close proximity to the hull bottom wall, said table and said round support means occupying a common horizontal plane; power means (58) for rotating said table around a vertical axis (21) coincident with the turret rotational axis; power means (at 52,54) for shifting an individual round of ammunition horizontally from the stationary round support means onto the upper surface of said table when the table is stationary; the table and turret being independently rotatable whereby the table can be moved to different rotated positions wherein different areas of the table are aligned with the stationary round support means; and means carried by the basket for transferring individual rounds of ammunition from the table into the space circumscribed by the basket, and thence into the aforementioned gun.

2. The improvement of claim 1 wherein the ammunition storing means comprises two chute systems located on opposite sides of the hull longitudinal centerline; said stationary round support means (49) being located on the hull longitudinal centerline; said conveyor means (46) comprising two separate conveyors occupying separate zones beneath respective ones of the chute systems; said separate conveyors being selectively movable to bring individual rounds of ammunition from the different chute systems to the round support means.

* * * * *